US007255291B1

(12) United States Patent
Lo

(10) Patent No.: US 7,255,291 B1
(45) Date of Patent: Aug. 14, 2007

(54) MULTIFUNCTIONAL SPRINKLER STRUCTURE

(75) Inventor: Shun Nan Lo, Changhua Hsien (TW)

(73) Assignee: Yuan Mei Corp., Changhua Hsien (TW)

( * ) Notice: Subject to any disclaimer, the term of this patent is extended or adjusted under 35 U.S.C. 154(b) by 0 days.

(21) Appl. No.: 11/544,028

(22) Filed: Oct. 6, 2006

(51) Int. Cl.

| | |
|---|---|
| ***B05B 3/16*** | (2006.01) |
| ***B05B 3/08*** | (2006.01) |
| ***B05B 3/04*** | (2006.01) |
| ***B05B 1/26*** | (2006.01) |
| ***B05B 1/12*** | (2006.01) |

(52) U.S. Cl. ..... 239/242; 239/231; 239/237; 239/240; 239/507; 239/509; 239/510; 239/DIG. 1; 239/515

(58) Field of Classification Search ..... 239/242, 239/231, 237, 240, 507, 509, 510, DIG. 1, 239/200, 201, 222.11, 222.13, 225.1, 232, 239/241, 251, 275, 276, 380, 381, 382, 461, 239/498, 505, 512, 513, 514, 516, 518, 521, 239/522, 524

See application file for complete search history.

(56) References Cited

U.S. PATENT DOCUMENTS

| | | | | |
|---|---|---|---|---|
| 4,277,029 | A * | 7/1981 | Rabitsch | 239/232 |
| 4,760,959 | A | 8/1988 | Gorney | 239/233 |
| 5,098,021 | A * | 3/1992 | Kah, Jr. | 239/242 |
| 5,267,689 | A | 12/1993 | Forer | 239/11 |
| 5,330,103 | A | 7/1994 | Eckstein | 239/242 |
| 5,611,488 | A * | 3/1997 | Frolich | 239/242 |
| 5,772,117 | A | 6/1998 | Su | 239/240 |
| 6,085,995 | A * | 7/2000 | Kah et al. | 239/237 |
| 6,164,562 | A * | 12/2000 | Wu | 239/237 |
| 6,651,904 | B2 | 11/2003 | Roman | 239/204 |
| 6,769,633 | B1 | 8/2004 | Huang | 239/457 |
| 6,899,287 | B2 | 5/2005 | Pinch et al. | 239/380 |
| 6,945,471 | B2 | 9/2005 | McKenzie et al. | 239/237 |
| 7,090,146 | B1 * | 8/2006 | Ericksen et al. | 239/200 |

* cited by examiner

*Primary Examiner*—Kevin Shaver
*Assistant Examiner*—Darren Gorman
(74) *Attorney, Agent, or Firm*—Troxell Law Office, PLLC

(57) ABSTRACT

A multifunctional sprinkler structure comprises a water motor having an outlet seat and a top cover mounted to a top-end side, and two adjusting seats and a water supply seat assembled onto a bottom-end side. The bottom-end side of the water motor has a guide groove with a restrictive hole for the extension of a switch shaft there-through. The outlet seat has a water-discharge chamber with multiple barriers extending thereon corresponding to an impeller of the water motor, and an oblique-extending central guide port matching to a spray nozzle having multiple water-guiding ribs obliquely extending towards the same direction therein. Therefore, the barriers of the outlet seat and the water-guiding ribs of the spray nozzle are utilized to correspond to the direction of the water flow so that the water discharge can be easily switched to eject either in more direct and forceful column-like spray or in more expanding spray.

6 Claims, 14 Drawing Sheets

MULTIFUNCTIONAL SPRINKLER STRUCTURE

BACKGROUND OF THE INVENTION

The present invention relates to a multifunctional sprinkler structure, comprising a water motor having an outlet seat and a top cover mounted to a top-end side, and two adjusting seats and a water supply seat assembled onto a bottom-end side wherein barriers of the outlet seat and water-guiding ribs of the spray nozzle are utilized to correspond to the direction of the water flow so that the water discharge can be easily switched to eject either in more direct and forceful column-like spray or in more expanding spray.

Conventional sprinklers (referring to U.S. Pat. No. 5,611,488 and German Patent No. DE4329616A1) include some disadvantages. For example, when the sprinkling control unit is adjusted to swing to the maximum angle, a switch shaft can hinder the smooth rotation of the sprinkler, which tends to make the sprinkler fail to swing a full 360 degrees and cause uneven distribution of the water discharge sprinkled onto the lawn thereon. Thus, the conventional sprinklers are reduced in function.

SUMMARY OF THE PRESENT INVENTION

It is, therefore, the primary purpose of the present invention to provide a multifunctional sprinkler structure, comprising a water motor having an outlet seat and a top cover mounted to a top-end side, and two adjusting seats and a water supply seat assembled onto a bottom-end side wherein barriers of the outlet seat and water-guiding ribs of a spray nozzle are utilized to correspond to the direction of water flow. When the water flow propels an impeller to rotate towards the direction of the barriers, the impetus of the water flow hindered by the barriers will become weakened. And when the water flow enters the spray nozzle, the water flow will run in a direction counter to that of the water-guiding ribs and further hindered thereby. Thus, the water flow will concentrate in the center of the spray nozzle to emit outwards in more direct and forceful column-like spray. However, when the water flow propels the impeller to spin towards the other side thereof, the water flow released from the hindrance of the barriers will flush directly towards the spray nozzle. Then, the water flow will run in a direction identical to that of the water-guiding ribs, and the water flow guided by the ribs will keep augmenting its impetus to eject in a radial direction outwards in more expanding spray thereby.

It is, therefore, the second purpose of the present invention to provide a multifunctional sprinkler structure wherein a switch shaft is applied to locate at one side of a sliding groove of a linking piece therein, which presets an appropriate space and allows the water motor to keep rotating till the switch shaft swinging from one side of the sliding groove to the other side thereof and pressed thereby so as to switch the direction of the water flow. Therefore, the sprinkler can operate accurately to achieve precise back-and-forth swing in 360 degrees so that the water discharge can be evenly distributed to sprinkle onto the lawn.

It is, therefore, the third purpose of the present invention to provide a multifunctional sprinkler structure wherein the top cover has an assembling groove for the engagement of a control piece therewith, and the control piece can be movable slid outwards to extend above the spray nozzle and hinder the water flow ejecting outwards in low parabola spray. Otherwise, the control piece is retrieved to locate at the assembling groove therein, permitting the water flow released from the hindrance thereof to emit outwards in high parabola spray. Thus, the sprinkler can be easily adjusted to switch the height of the water discharge sprinkling onto the lawn in either farther or nearer range, achieving more flexible application of the sprinkler and boosting its functions thereof.

DETAILED DESCRIPTION OF THE PREFERRED EMBODIMENTS

Figure 1:
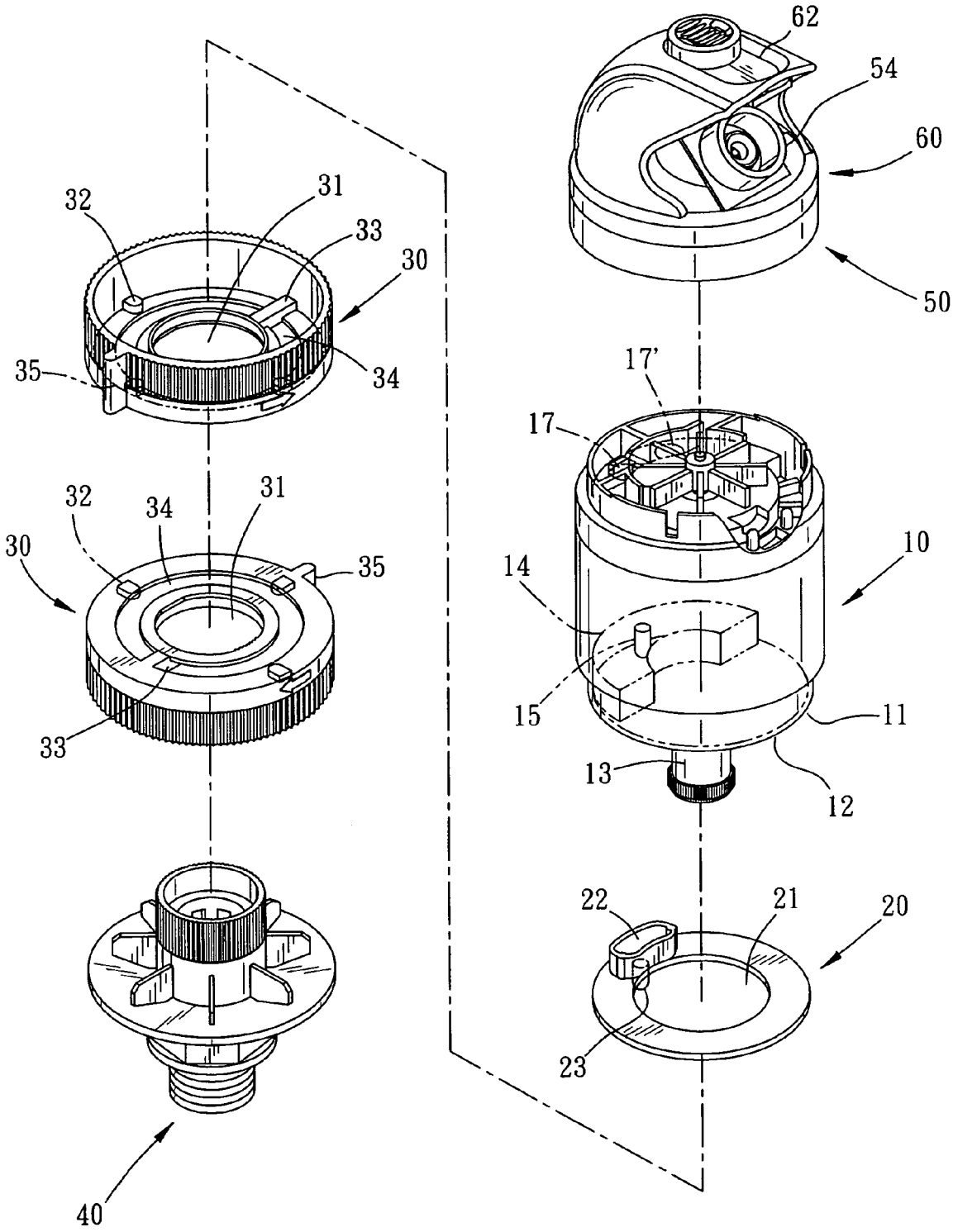
FIG. 1 is an exploded perspective view of the present invention.
Figure 2:
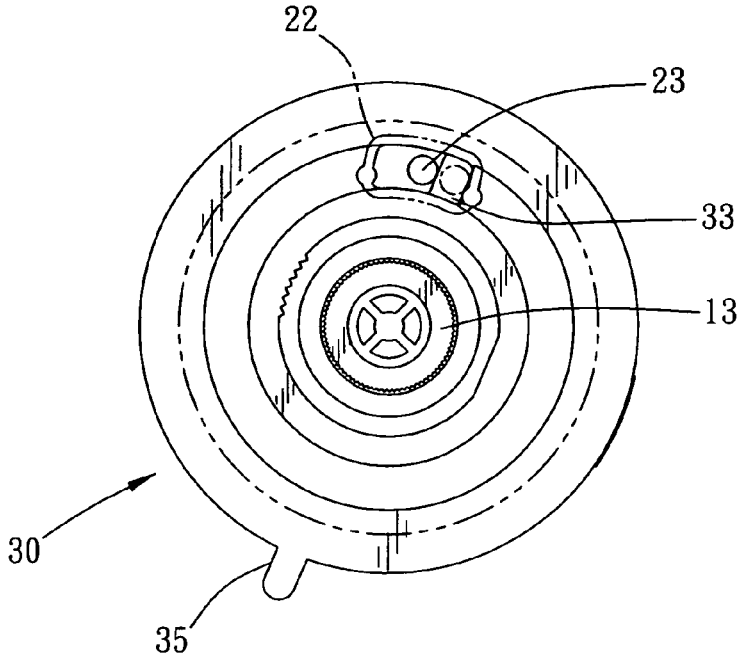
FIG. 2 is a flat view of a linking piece and adjusting seats of the present invention assembled onto a water motor.

Please refer to FIGS. 1, 2. The present invention relates to a multifunctional sprinkler structure, comprising a water motor 10, a linking piece 20, two adjusting seats 30, a water supply seat 40, an outlet seat 50, and a top cover 60. The water motor 10 has a bottom-end side 11 with a guide edge 12 extending downwards from the external periphery, and a connector protruding in the middle for the extension of an inlet tube 13 there-through. The bottom-end side 11 has an arcuate guide groove 14 with a restrictive hole indented at one side thereon for the extension of a switch shaft 15 there-through. The linking piece 20 and the two adjusting seats 30 are respectively equipped with a bore 21, 31 extending through the center thereon to be sequentially guided through the inlet tube 13 and mounted to the water motor 10 thereby. The linking piece 20, abutting against the bottom-end side 11, is restricted by the guide edge 12 to keep an even surface therewith. The linking piece 20 has one side equipped with an arcuate sliding groove 22 and a push shaft 23 respectively situated at the corresponding top and bottom surfaces thereon, permitting the switch shaft 15 to precisely accommodate into the sliding groove 22 thereby. The two adjusting seats 30 are correspondingly joined to the bottom-end side 11 of the water motor 10. And the inner surface of the adjusting seat 30 is equipped with multiple guide blocks 32 to precisely abut against the guide edge 12 thereon, permitting the linking piece 20 to keep an appropriate distance from the inner surface of one adjusting seat 30 thereby. Each adjusting seat 30 also includes a positioning passage 34 annularly defining thereon and a stop rib 33 extending at the positioning passage 34 thereon. Thus, the push shaft 23 is allowed to precisely accommodate into the positioning passage 34 and limited in position by the stop rib 33 thereof. Besides, an angle-adjusting plate 35 is provided protruding at the outer periphery of the adjusting seat 30 in opposite to the stop rib 33 thereof. The angle-adjusting plate 35 has a height identical to that of the adjusting seat 30. The water supply seat 40 is coupled with one of the two adjusting seats 30 and securely joined to the inlet tube 13 so that water flow is allowed to run through the water supply seat 40 and the inlet tube 13 to enter the water motor 10 thereby.

Figure 3:
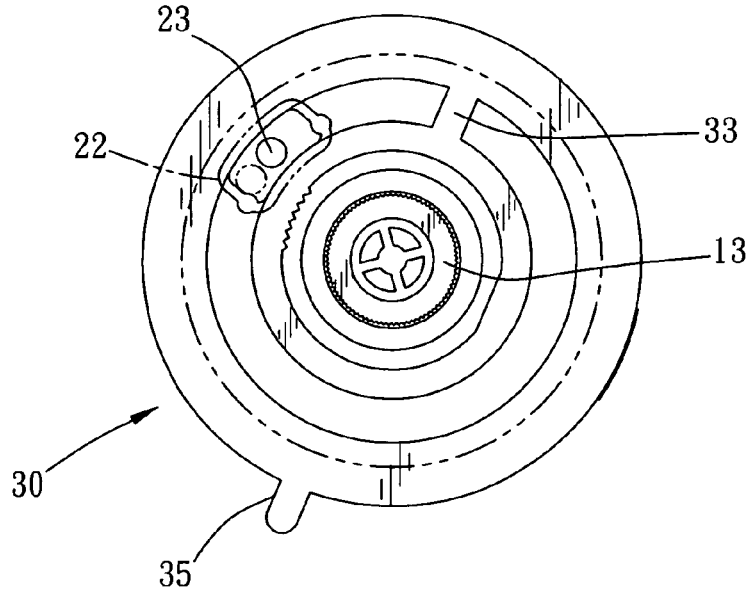
FIG. 3 is a diagram showing the operation of the linking piece synchronically moved with the water motor of the present invention.
Figure 4:
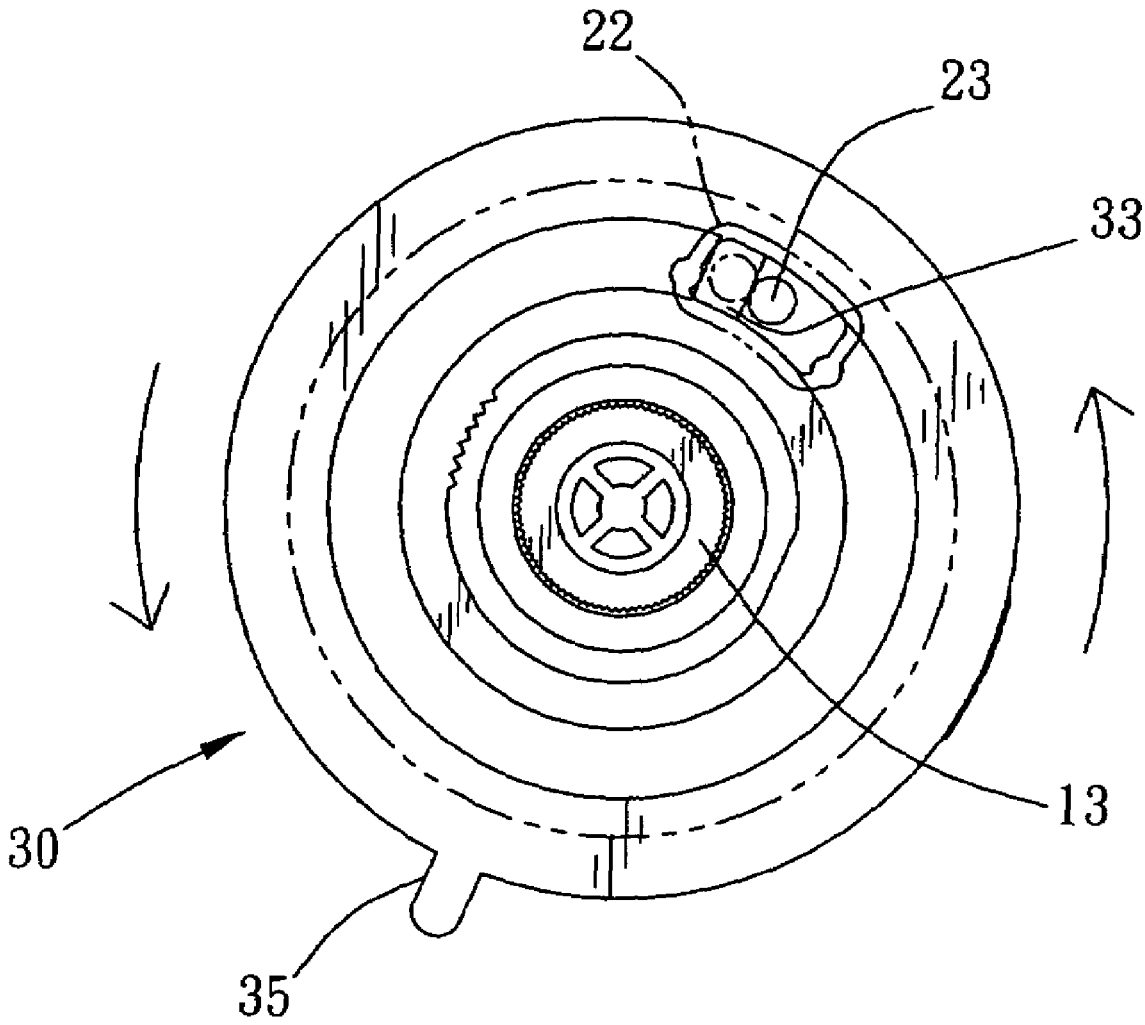
FIG. 4 is a diagram showing the water motor of the present invention rotated to 360 degrees in operation.

Please refer to FIGS. 3, 4. When the two angle-adjusting plates 35 of the two adjusting seats 30 are regulated into the same position, the switch shaft 15 accommodated into the sliding groove 22 of the linking piece 20 correspondingly works with the push shaft 23 received into the positioning passages 34 and restricted in position by the stop ribs 33 of the adjusting seats 30 thereof. The switch shaft 15 will slide along with the rotation of the water motor 10 to contact one side of the sliding groove 22 and actuate the linking piece 20 to slide along the guide edge 12 and synchronically move with the water motor 10 till the push shaft 23 sliding along the positioning passages 34 of the adjusting seats 30 is hindered by the stop ribs 33 thereof. Then, the linking piece 20 will stop revolving, and the switch shaft 15 positioned at one side of the sliding groove 22 presets an appropriate space, permitting the water motor 10 to keep rotating till the switch shaft 15 swinging from one side of the sliding groove 22 to the other side and pressed thereby so as to switch the direction of the water flow thereby. Therefore, the sprinkler can operate accurately to swing back and forth in 360 degrees so that the water discharge can be evenly distributed to sprinkle onto the lawn.

Figure 5:
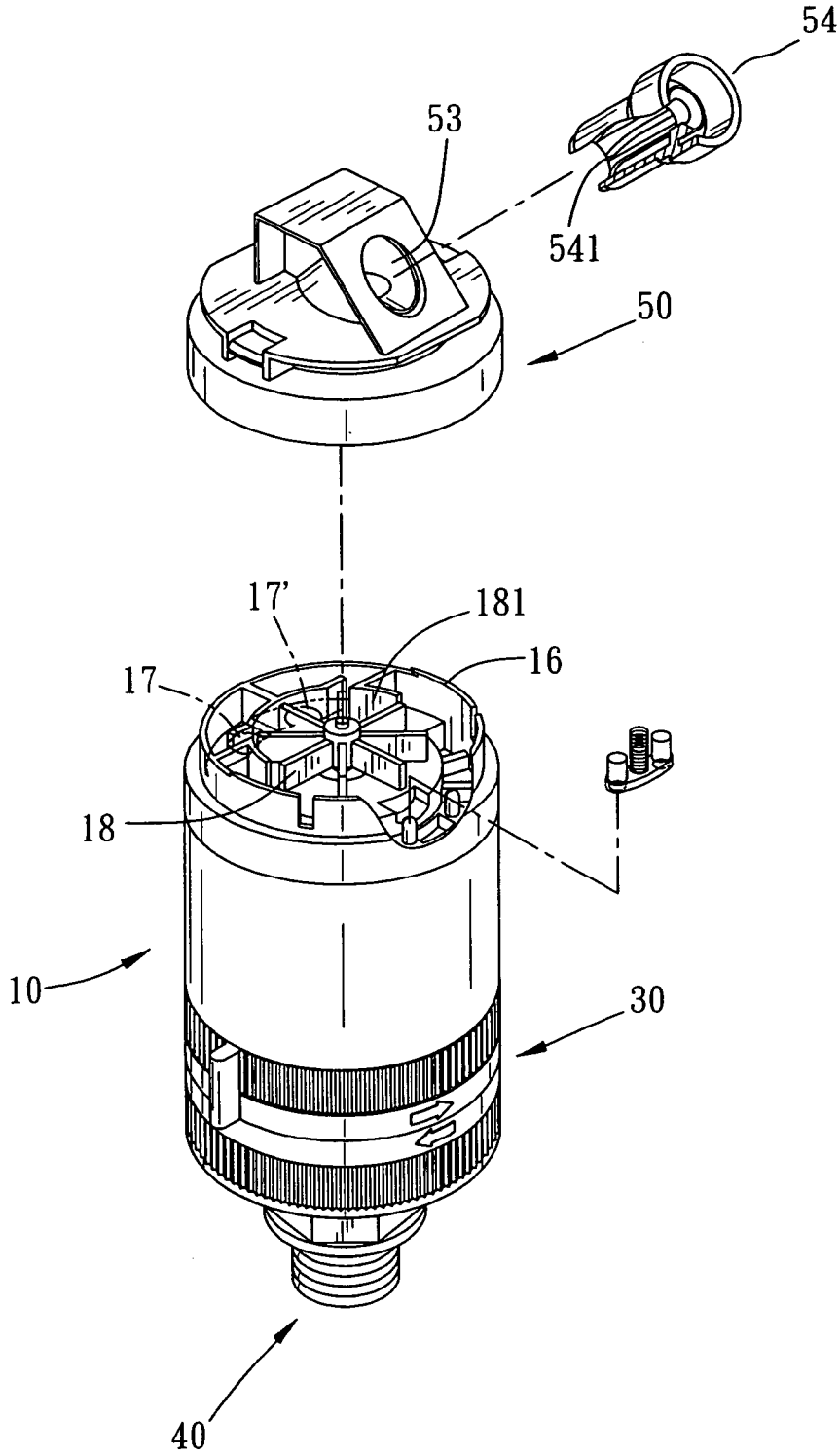
FIG. 5 is another exploded perspective view of the present invention.
Figure 6:
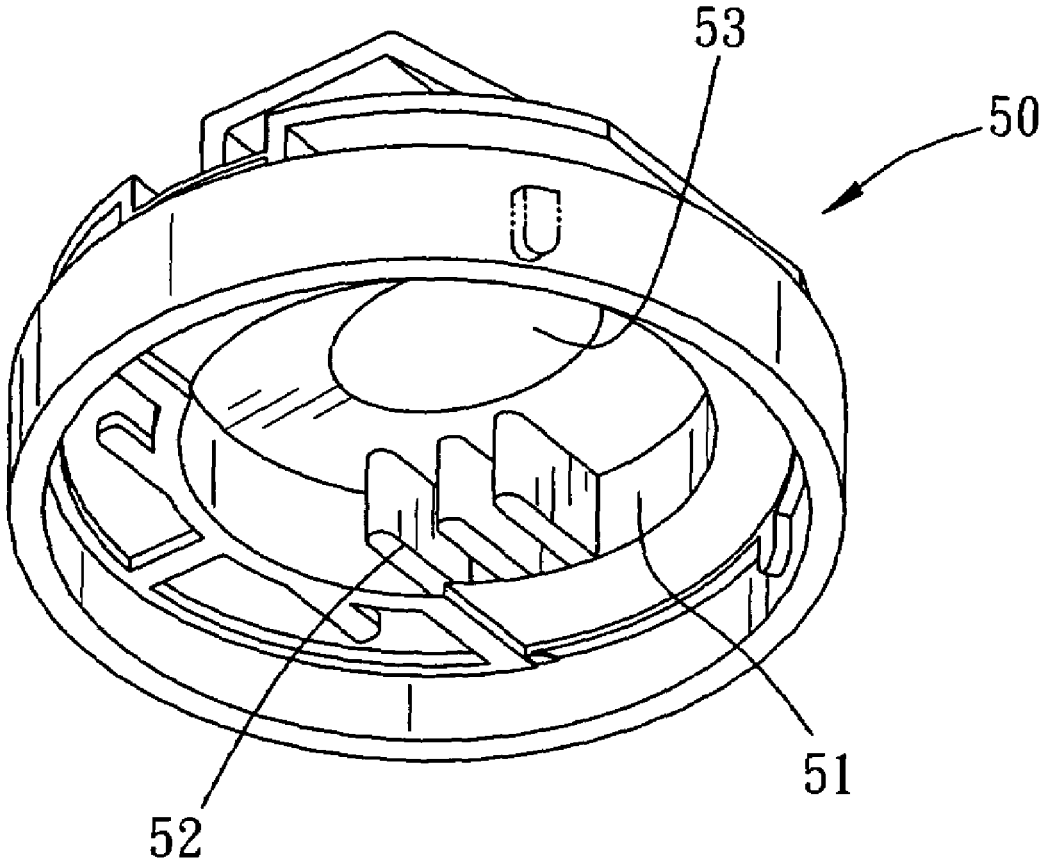
FIG. 6 is a diagram showing the interior of an outlet seat of the present invention.
Figure 7:
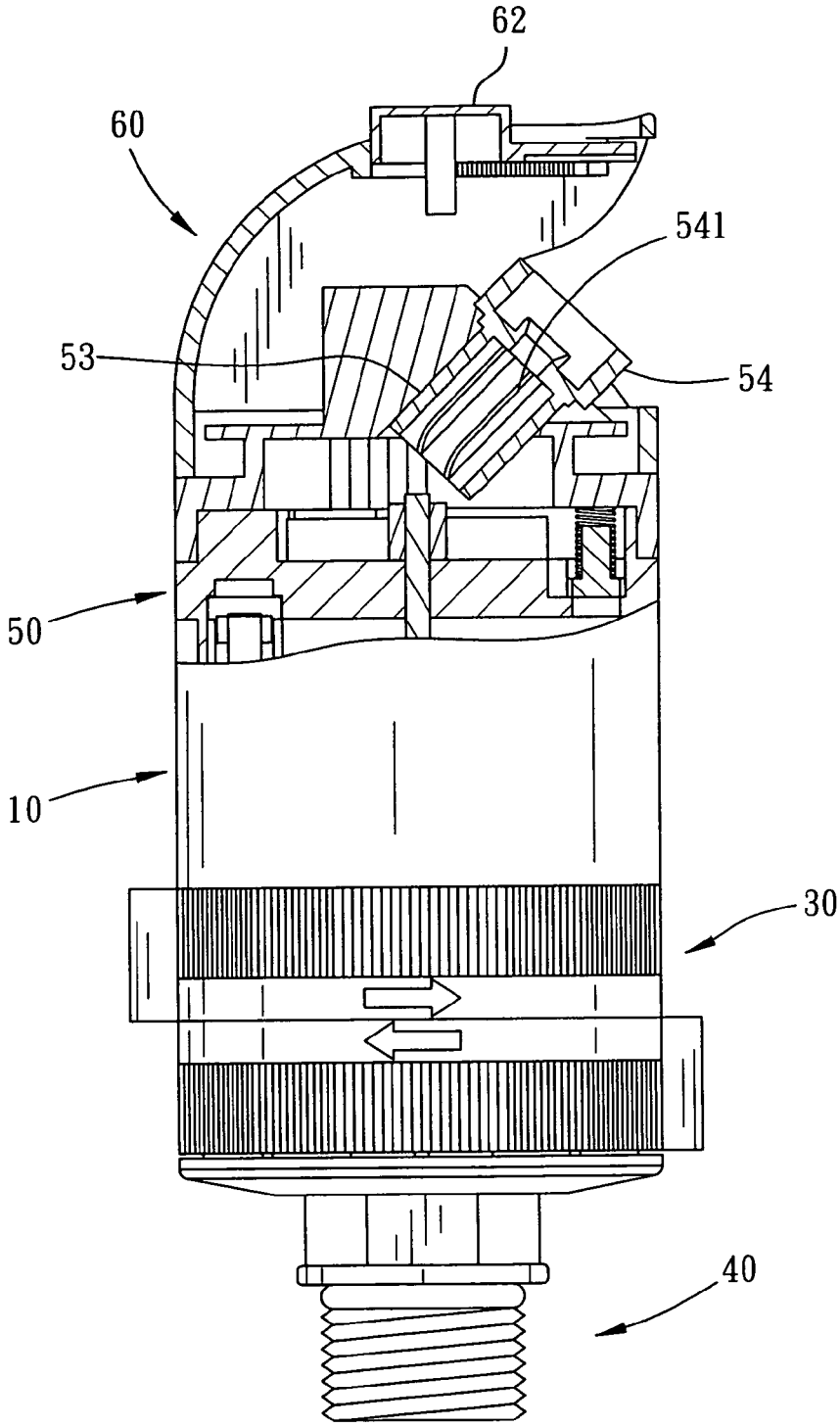
FIG. 7 is an assembled and partially cross sectional view of the present invention.

Please refer to FIG. 5 showing a second exploded perspective view of the present invention. The water motor 10 has a top-end side 16 with two outlet orifices 17, 17' extending there-through to correspond to an impeller 18 accommodated to a water-intake chamber 181 therein. The outlet seat 50 (referring to FIG. 6), mounted to the top-end side 16 of the water motor 10, is provided with a water-discharge chamber 51 indented at the interior therein to correspond to the impeller 18 thereof. The water-discharge chamber 51 has multiple barriers 52 extending at one sidewall, and a guide port 53 obliquely extending through the center thereon to match to a spray nozzle 54 thereby. The spray nozzle 54 has an internal wall equipped with multiple oblique-extension water-guiding ribs 541 identically slanting towards the same direction thereof. The top cover 60 (referring to FIG. 7) is mounted on top of the outlet seat 50 thereon.

Figure 8:
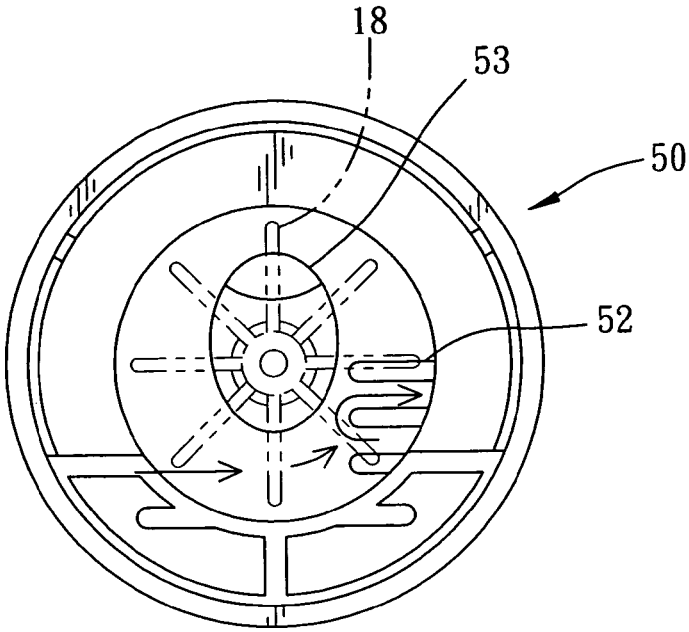
FIG. 8 is a diagram showing the direction of the water flow hindered by barriers disposed at the interior of the outlet seat thereof.
Figure 9:
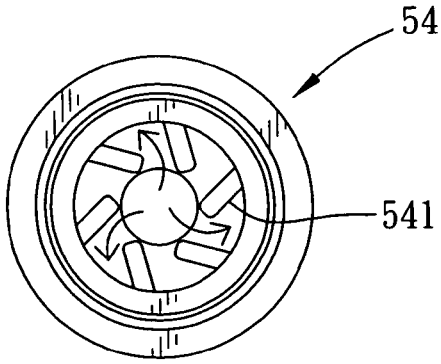
FIG. 9 is a diagram showing the water flow of FIG. 8 running counter to and hindered by water-guiding ribs disposed at the interior of a spray nozzle thereof.
Figure 10:
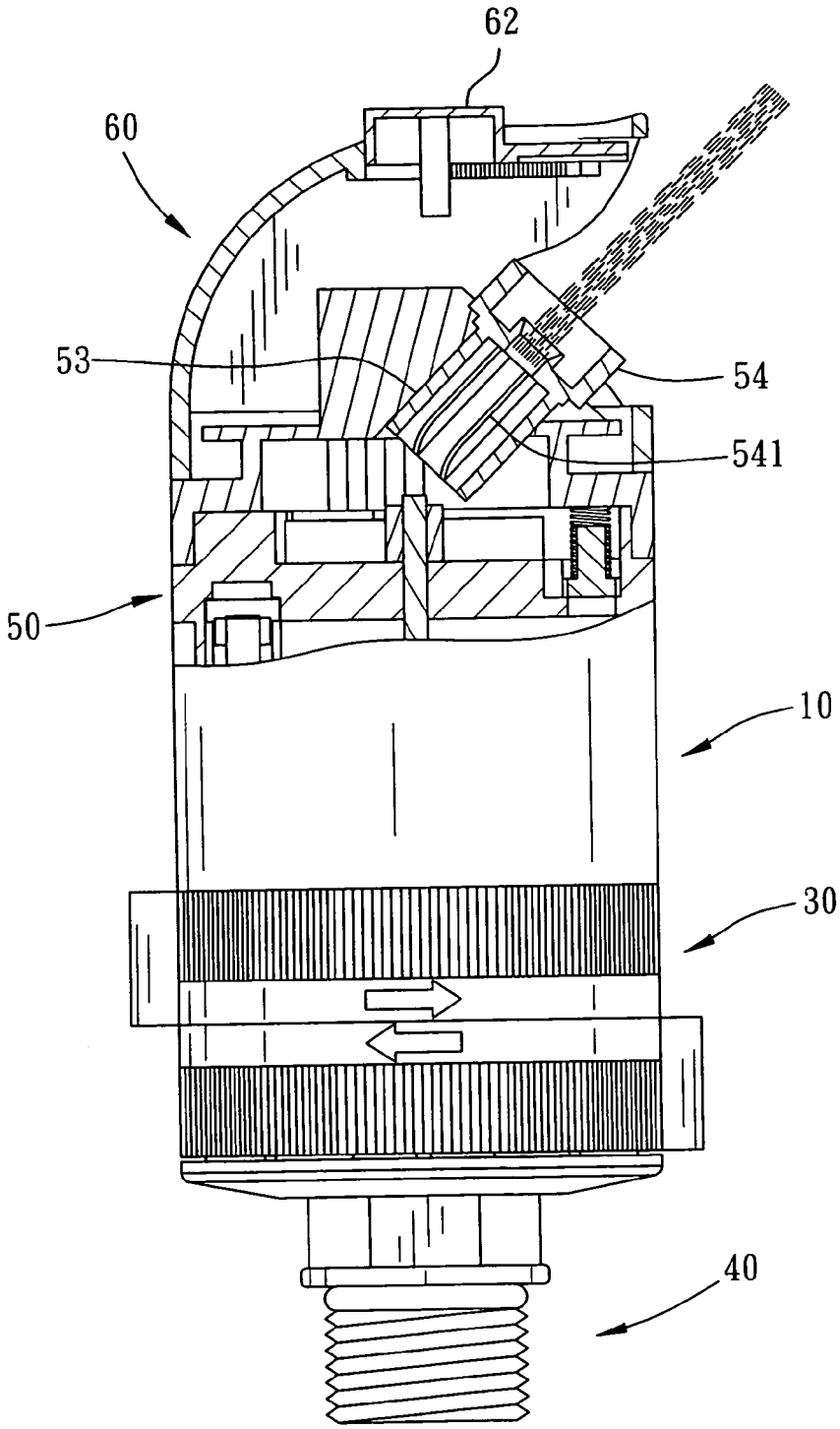
FIG. 10 is a diagram showing the water flow of FIG. 9 ejecting outwards in straight spray.
Figure 11:
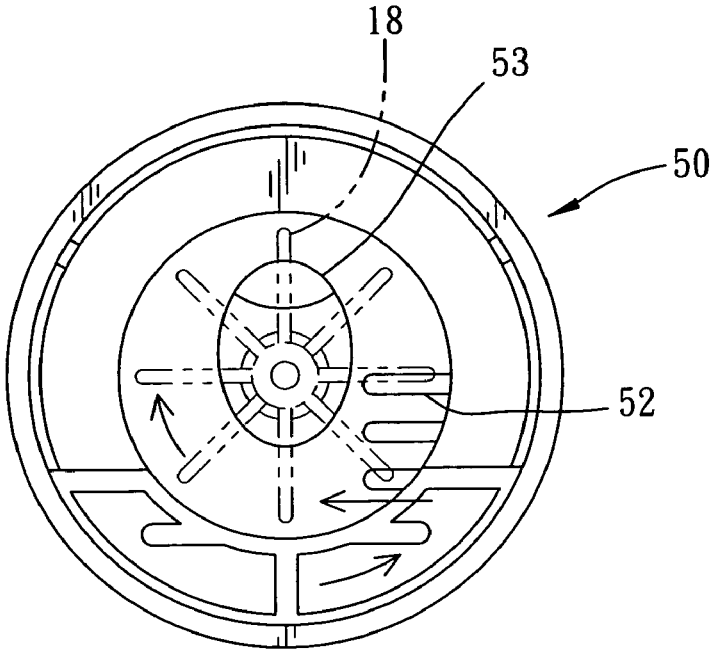
FIG. 11 is a diagram showing the water flow unhindered by the barriers of the outlet seat and directly guided into the spray nozzle thereof.
Figure 12:
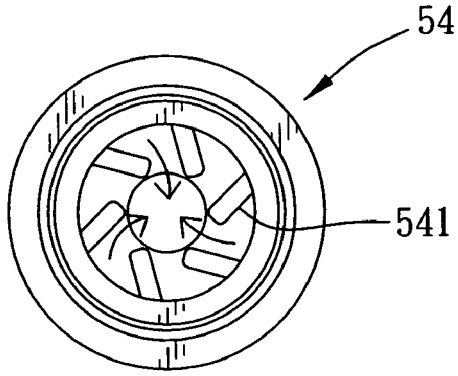
FIG. 12 is a diagram showing the water flow of FIG. 11 running identically to the direction of the water-guiding ribs of the spray nozzle and augmenting its impetus thereby.
Figure 13:
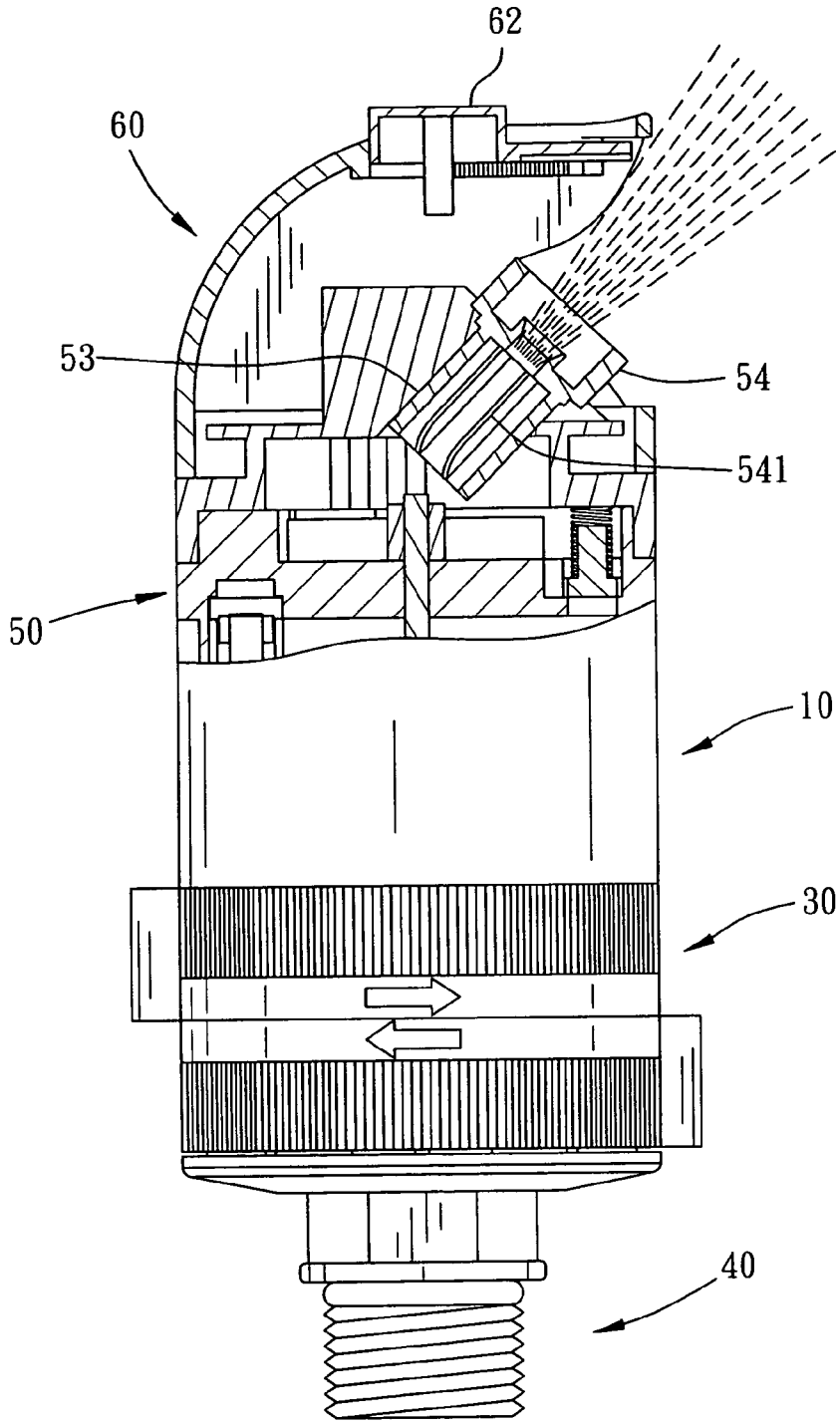
FIG. 13 is a diagram showing the water flow of FIG. 12 ejecting outwards in expanding spray.

Please refer to FIG. 8. When the water flow collectively goes through one outlet orifice 17 of the water motor 10, the water flow gathered in the water-intake chamber 181 will propel the impeller 18 to rotate towards the direction of the barriers 52. The impetus of the water flow hindered by the barriers 52 will become weakened thereby. Then, when the water flow enters the spray nozzle 54, the water flow will run in a direction counter to that of the water-guiding ribs 541 as shown in FIG. 9, which will further decrease the impetus of the water flow thereby. Thus, the water flow will concentrate in the center of the spray nozzle 54 to eject outwards in more direct and forceful column-like spray as shown in FIG. 10. However, when the water flow comes out through the other outlet orifice 17', the impeller 18 will be propelled to spin towards the other side as shown in FIG. 11 so that the water flow released from the hindrance of the barriers 52 will flush directly towards the spray nozzle 54. Then, the water flow will run in a direction identical to that of the water-guiding ribs 541 as shown in FIG. 12, and the water flow guided by the ribs 541 will keep augmenting its impetus to eject in a radial direction outwards in more expanding spray as shown in FIG. 13.

Figure 14:
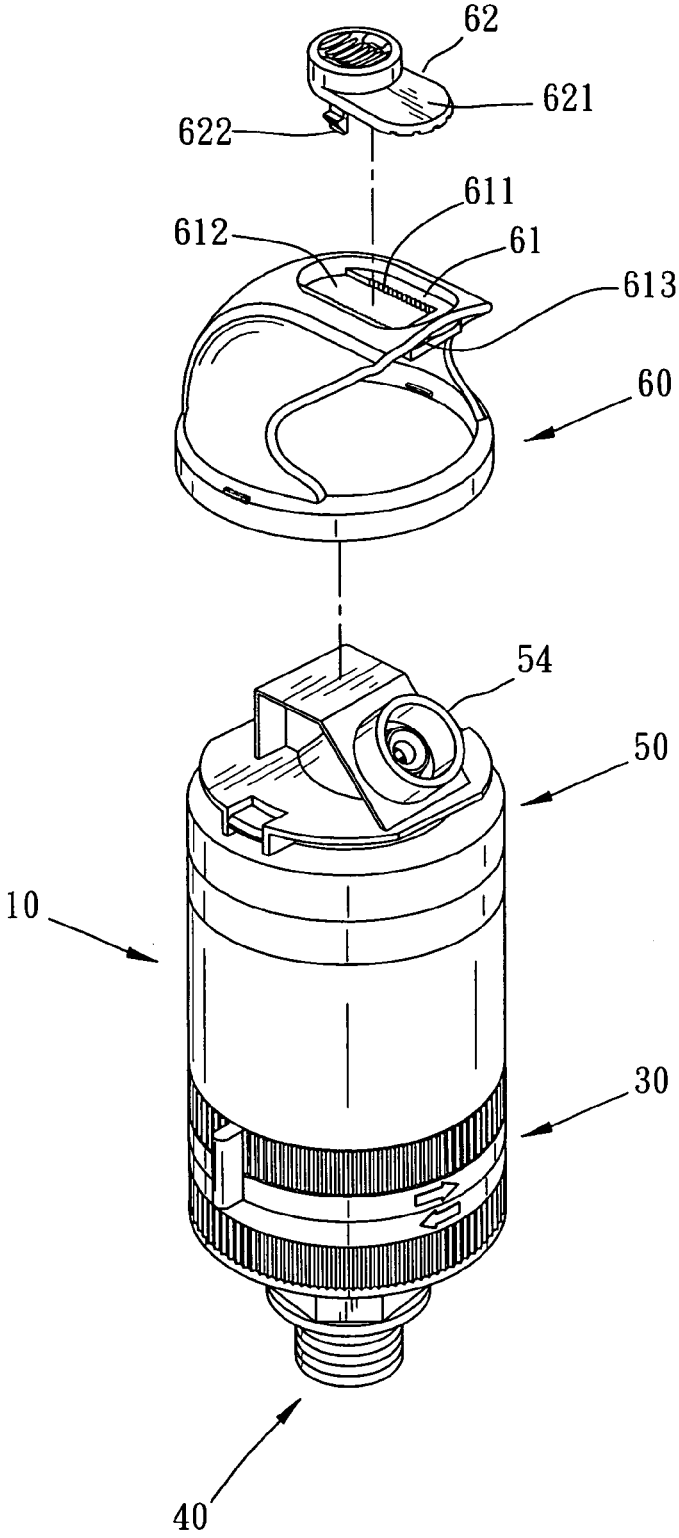
FIG. 14 is a third exploded perspective view of the present invention.
Figure 15:
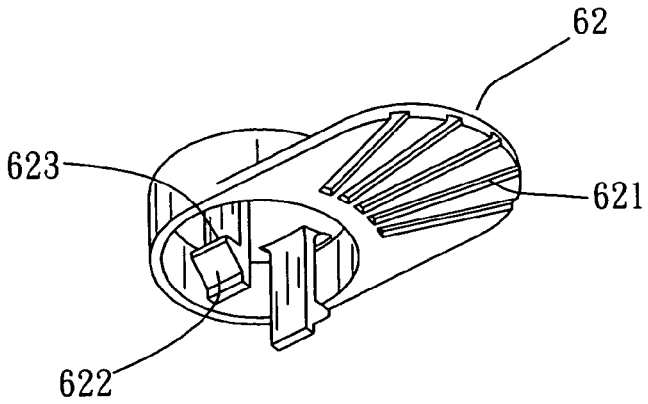
FIG. 15 is a perspective view taken from a bottom side of a control piece of the present invention.
Figure 16:
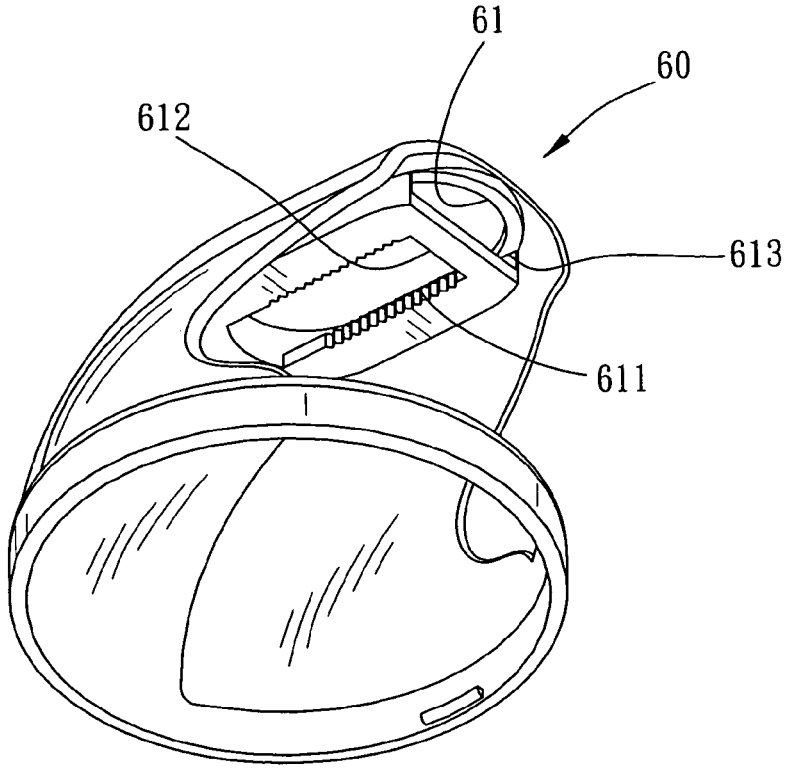
FIG. 16 is a perspective view showing the interior of a top cover of the present invention.
Figure 17:
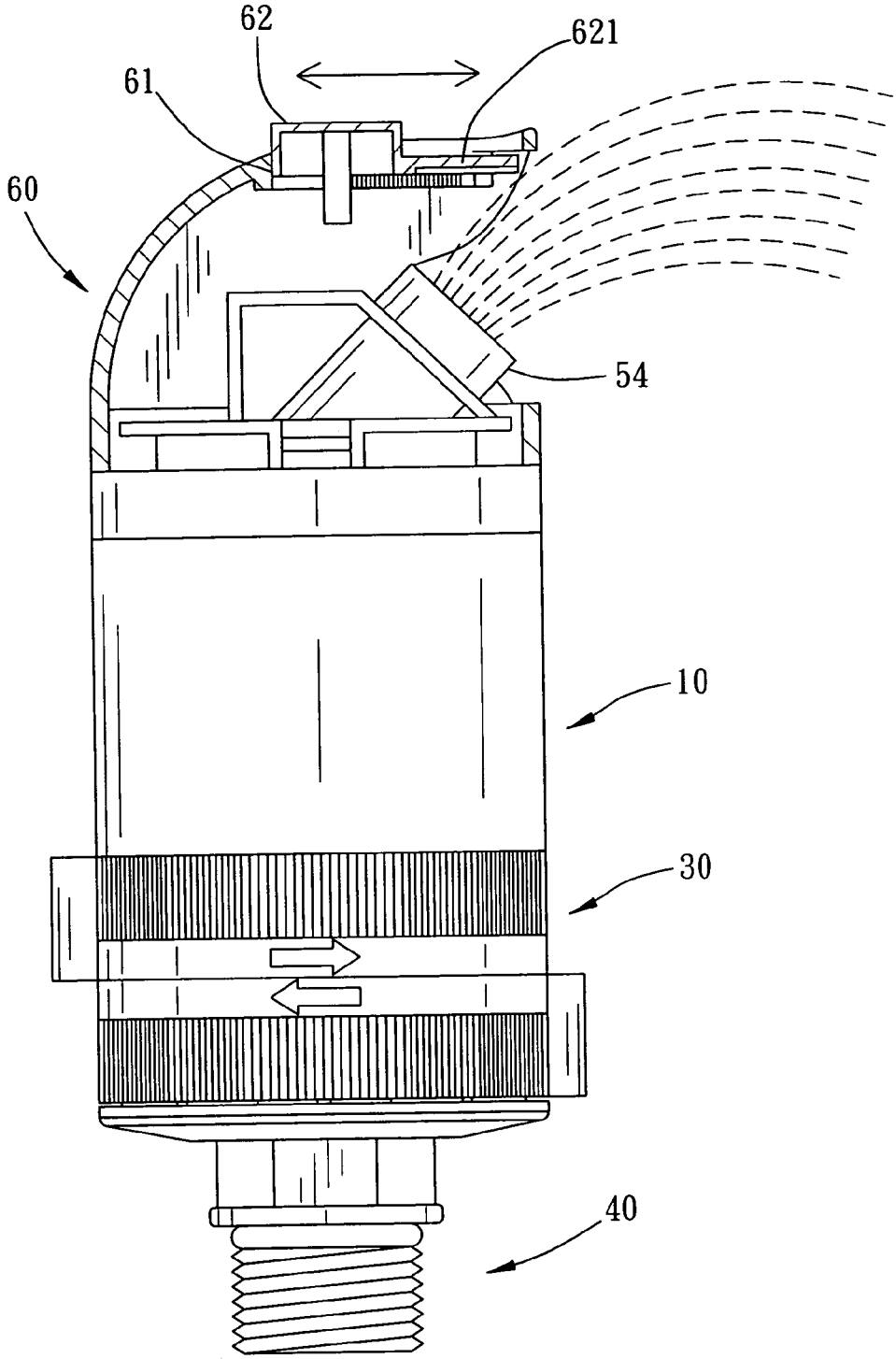
FIG. 17 is a diagram showing the water flow of the present invention unhindered by the control piece and ejecting outwards in high parabola spray.
Figure 18:
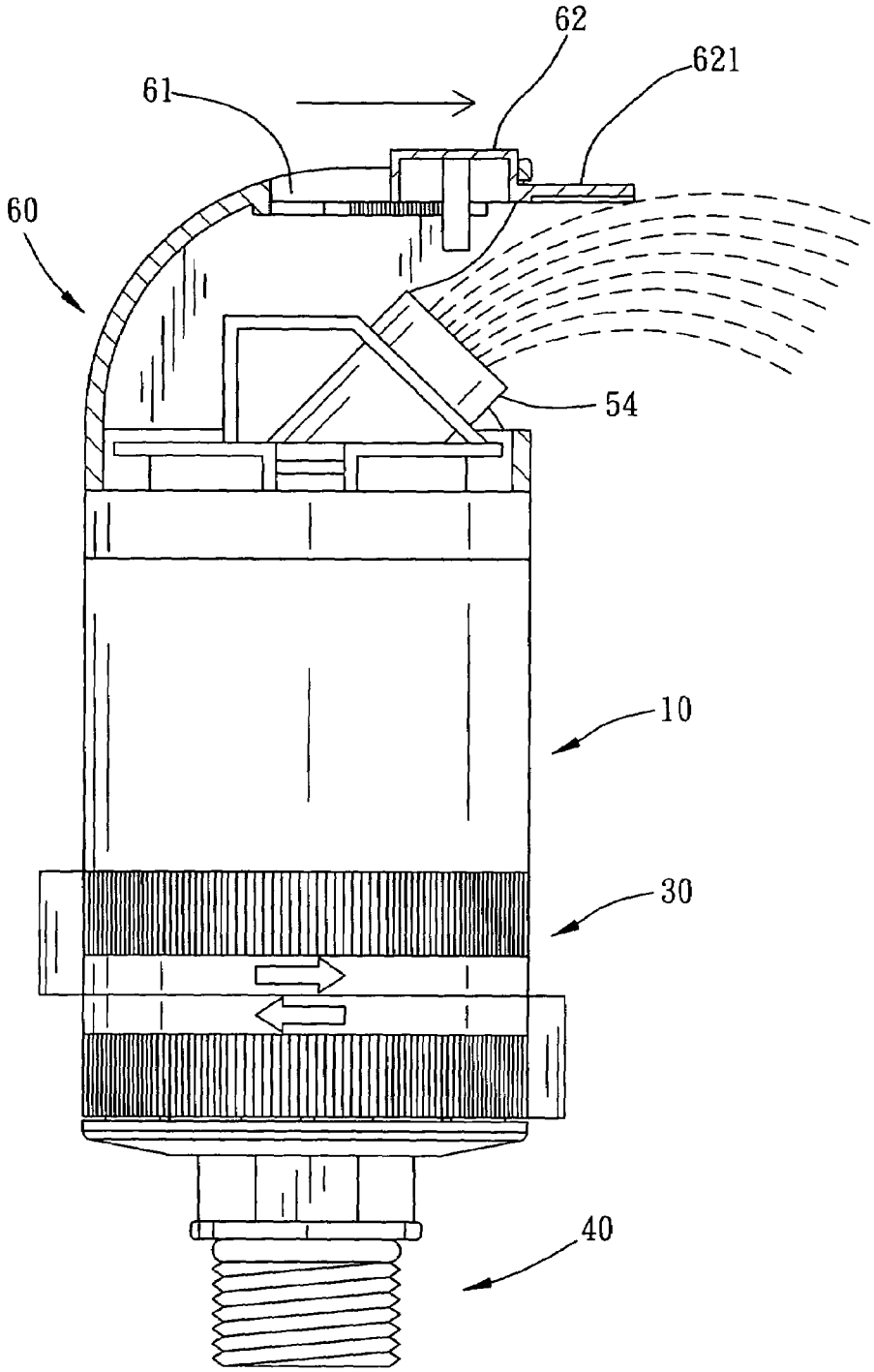
FIG. 18 is a diagram showing the control piece moved to the front end of the top cover with the water flow hindered by a stop plate and ejecting in low parabola spray.

Referring to FIGS. 14 to 16 inclusively. The top cover 60 has an assembling groove 61 indented at the top surface thereon to which a control piece 62 with a stop plate 621 extending thereon is reciprocally joined. The assembling groove 61 has a bottom defined by a limiting slot 612 with multiple adjusting toothed recesses 611 disposed at both lateral sidewalls thereon. Besides, an opening 613 is disposed at the front side of the assembling groove 61 to correspond to the stop plate 621 thereby. The control piece 62 has a pair of flexible hooked legs 622 protruding at the bottom thereon to precisely hook to both bottom lateral sides of the limiting slot 612 thereby. Each flexible hooked leg 622 has a toothed rib 623 protruding at the external side to mesh with the adjusting toothed recesses 611 thereby. When the control piece 62 is inserted into the assembling groove 61, the water flow ejecting outwards from the spray nozzle 54 without any hindrance will sprinkle outwards in high parabola spray as shown in FIG. 17 so as to distribute the water discharge onto the lawn in farther range. However, when the flexible hooked legs 622 of the control piece 62 are guided along the limiting slot 612 of the assembling groove 61 to push the stop plate 621 extending outwards through the opening 213, the water flow ejecting outwards from the spray nozzle 54 will be hindered by the stop plate 621 to emit outwards in low parabola spray as shown in FIG. 18 so as to sprinkle the lawn in nearer range. Therefore, the sprinkler of the present invention can provide more flexible operation and is highly boosted in functions.

What is claimed is:

1. A multifunctional sprinkler structure wherein a water motor has a top-end side to which an outlet seat and a top cover are sequentially mounted, and a bottom-end side with which two adjusting seats and a water supply seat are engaged; the bottom-end side of the water motor has a guide groove with a restrictive hole indented at one side thereon for the extension of a switch shaft there-through, and the outlet seat is provided with a water-discharge chamber indented at the interior therein to correspond to an impeller of the water motor thereby; the water-discharge chamber has multiple barriers extending at one sidewall thereon, and a guide port obliquely extending through the center of the water-discharge chamber to match to a spray nozzle thereby;

the spray nozzle has an internal wall defined by multiple water-guiding ribs obliquely extending towards the same direction thereof wherein the barriers of the outlet seat and the water-guiding ribs of the spray nozzle are defined in conformance to the direction of the water flow; thus, when the water flow propels the impeller to rotate towards the direction of the barriers, the impetus of the water flow hindered by the barriers will become weakened, and when the water flow enters the spray nozzle, the water flow will run in a direction counter to that of the water-guiding ribs and further hindered thereby; then, the water flow will concentrate in the center of the spray nozzle to eject outwards in a direct and forceful column-like spray; however, when the water flow propels the impeller to spin towards the other side thereof, the water flow released from the hindrance of the barriers will flush directly towards the spray nozzle; then, the water flow will run in a direction identical to that of the water-guiding ribs, and the water flow guided by the ribs will keep augmenting its impetus to eject in a radial direction outwards in an expanding spray thereby.

2. A multifunctional sprinkler structure wherein a water motor has a top-end side to which an outlet seat and a top cover are sequentially mounted, and a bottom-end side to which two adjusting seats and a water supply seat are connected; the bottom-end side of the water motor has a guide groove with a restrictive hole indented at one side thereon for the extension of a switch shaft there-through, and a linking piece is provided in abutment against the bottom-end side of the water motor; the linking piece has a bore extending through the center thereof, and a side having a sliding groove and a push shaft respectively disposed at the corresponding upper and lower surfaces thereon, permitting the switch shaft to precisely accommodate into the sliding groove, and the push shaft to accurately receive into positioning passages of the two adjusting seats and get hindered only by stop ribs extending thereon; each adjusting seat also has an identical-height angle-adjusting plate extending at the outer periphery thereon wherein the switch shaft is positioned at one side of the sliding groove therein, which presets an appropriate space and allows the water motor to keep rotating till the switch shaft swings from one side of the sliding groove to the other side thereof; therefore, the sprinkler can operate accurately to achieve precise back-and-forth swing in 360 degrees so that the water discharge can be evenly distributed to sprinkle onto a lawn.

3. The multifunctional sprinkler structure as claimed in claim 2 wherein the water motor has a guide edge extending downwards at the outer periphery of the bottom-end side thereon to keep an even surface with the linking piece thereof, and the two adjusting seats have multiple guide blocks disposed at an inner surface thereon to precisely abut against the guide edge so that the linking piece can keep an appropriate distance from the inner surface of one adjusting seat thereby.

4. A multifunctional sprinkler structure, comprising a water motor equipped with a top-end side to which an outlet seat and a top cover are mounted, and a bottom-end side to which two adjusting seats and a water supply seat are joined wherein the top cover has an assembling groove with an opening indented at the top surface thereon with which a control piece with a stop plate extending thereon is reciprocally engaged; thus, the control piece can be movably slid outwards to extend above the spray nozzle and hinder the water flow ejecting outwards in low parabola spray; otherwise, the control piece is retrieved to locate at the assembling groove therein, permitting the water flow released from the hindrance thereof to emit outwards in high parabola spray; therefore, the sprinkler is easily adjusted to switch the height of the water discharge so as to evenly sprinkle the lawn in both farther and nearer range thereby, achieving more flexible application of the sprinkler thereof.

5. The multifunctional sprinkler structure as claimed in claim 4 wherein the bottom of the assembling groove and the control piece are respectively equipped with a limiting slot and a pair of flexible hooked legs that are reciprocally hooked to each other thereby.

6. The multifunctional sprinkler structure as claimed in claim 5 wherein the limiting slot of the assembling groove has multiple adjusting toothed recesses defined on both lateral sidewalls thereof, and each flexible hooked leg of the control piece has a toothed rib protruding at an external side to mesh with the adjusting toothed recesses thereby.

* * * * *